US008744100B2

(12) United States Patent
Kojima

(10) Patent No.: US 8,744,100 B2
(45) Date of Patent: Jun. 3, 2014

(54) HEARING AID IN WHICH SIGNAL PROCESSING IS CONTROLLED BASED ON A CORRELATION BETWEEN MULTIPLE INPUT SIGNALS

(75) Inventor: Mariko Kojima, Hyogo (JP)

(73) Assignee: Panasonic Corporation, Osaka (JP)

( * ) Notice: Subject to any disclaimer, the term of this patent is extended or adjusted under 35 U.S.C. 154(b) by 553 days.

(21) Appl. No.: 12/472,627

(22) Filed: May 27, 2009

(65) Prior Publication Data

US 2009/0296965 A1 Dec. 3, 2009

(30) Foreign Application Priority Data

May 27, 2008 (JP) ..... 2008-137575

(51) Int. Cl.
*H04R 25/00* (2006.01)

(52) U.S. Cl.
USPC ..... 381/312; 381/317; 381/321

(58) Field of Classification Search
USPC ..... 381/56, 57, 312, 317, 321
See application file for complete search history.

(56) References Cited

U.S. PATENT DOCUMENTS

| | | | |
|---|---|---|---|
| 5,636,285 | A | 6/1997 | Sauer |
| 6,816,600 | B1 | 11/2004 | Jakob et al. |
| 2002/0077831 | A1 | 6/2002 | Numa |
| 2005/0238190 | A1 | 10/2005 | Rohrlein |
| 2005/0244020 | A1 | 11/2005 | Nakajima et al. |
| 2006/0204025 | A1* | 9/2006 | Paludan-Muller et al. ... 381/317 |
| 2007/0009122 | A1 | 1/2007 | Hamacher |
| 2007/0009126 | A1 | 1/2007 | Fischer |
| 2007/0071262 | A1 | 3/2007 | Rass |
| 2007/0086608 | A1 | 4/2007 | Hashimoto et al. |

FOREIGN PATENT DOCUMENTS

| | | |
|---|---|---|
| JP | 5-333894 | 12/1993 |
| JP | 2002-078704 | 3/2002 |
| JP | 2002-162990 | 6/2002 |
| JP | 2003-511876 | 3/2003 |
| JP | 2005-130427 | 5/2005 |
| JP | 3760173 | 3/2006 |
| JP | 3865600 | 1/2007 |
| JP | 2007-028609 | 2/2007 |
| JP | 2007-101305 | 4/2007 |
| JP | 2007-259008 | 10/2007 |
| JP | 2008-042741 | 2/2008 |
| WO | 2004/021738 | 3/2004 |

* cited by examiner

*Primary Examiner* — Brian Ensey
(74) *Attorney, Agent, or Firm* — Wenderoth, Lind & Ponack, L.L.P.

(57) ABSTRACT

The user's personal intention is conveyed to a hearing aid using a method that does not place heavy physical and psychological loads. A hearing aid to be worn by a user for auditory compensation comprises: at least one microphone which converts a sound to an input signal; a hearing-aid signal processing unit configured to generate an output signal from the input signal; a receiver which outputs, as a sound, the output signal generated by the hearing-aid signal processing unit; and a hearing-aid processing control unit configured to generate control information for controlling signal processing, based on a non-audible sound which is made by the user and is hard to hear from outside, wherein, when the hearing-aid processing control unit generates the control information, the hearing-aid signal processing unit is configured to generate the output signal according to the generated control information.

8 Claims, 8 Drawing Sheets

FIG. 5

25a

| Non-audible sound information | Intention information |
|---|---|
| "too loud", "quieter" | Noise is too loud |
| "louder", "turn it up" | Volume is low |
| "can't hear" "pardon?", "what?" (unintentional) | Can't hear conversation |
| "** (name of program mode)" | Want to switch to specified mode |
| Teeth clicking sound | Want to invalidate all functions |
| Frequent generation of friction sound between hair or skin and hearing aid | Want to search for surrounding sound |
| ⋮ | ⋮ |

FIG. 6

29a

| Intention information | Noise information | Speech information | Control information |
|---|---|---|---|
| Noise is too loud | High | No | Overall volume down |
| Volume is low | Low | No | Overall volume up |
| Can't hear conversation | High | Yes | Maximize noise suppression level |
| | Low | Yes | Directional function ON<br>Overall volume up |
| Want to switch to specified mode | — | — | Switch to specified mode |
| Want to invalidate all functions | — | — | Mute function ON |
| Want to search for surrounding sound | — | — | Directional function OFF |
| ⋮ | ⋮ | ⋮ | ⋮ |

HEARING AID IN WHICH SIGNAL PROCESSING IS CONTROLLED BASED ON A CORRELATION BETWEEN MULTIPLE INPUT SIGNALS

BACKGROUND OF THE INVENTION (1) Field of the Invention

The present invention relates to hearing aids worn by users for auditory compensation.

(2) Description of the Related Art

Hearing aids of recent years are equipped with multiple functions such as directional control, noise suppression, and automatic volume adjustment. For example, hearing aids themselves determine the environment surrounding the user, such as the surrounding noise level, and control signal processing (hereinafter referred to as hearing-aid processing) according to the determined environment. By automatically controlling the hearing-aid processing according the surrounding environment in such a manner, the hearing aids are capable of providing the users with improved "hearing" (for example, see Patent Reference 1: Japanese Patent No. 3865600).

However, the sounds which the users wish to hear do not solely depend on the surrounding environment. The sounds which the users wish to hear change depending on the situation that the individual users are in and on the psychological status of the users. Therefore, with the above method in which the hearing aids automatically determine the surrounding environment and control the hearing-aid processing according to the determined environment, optimal "hearing" may not be provided to every user. Therefore, when there is a difference between the output sound of the hearing aid and the sound which the user wishes to hear, the user's intention needs to be conveyed to the hearing aid in some form.

In view of the above, conventional hearing aids generally have a switch or the like on the body or on a remote control that comes with a hearing aid for conveying the user's intention to the hearing aid. FIG. 8 is a block diagram illustrating the functional structure of a conventional hearing aid 100. A hearing-aid signal processing unit 115 generates an output signal from an input signal generated by an air-conduction microphone 111. Then, a receiver 116 outputs as a sound the output signal generated by the hearing-aid signal processing unit 115. The hearing-aid processing control unit 114 determines the surrounding environment based on an input signal, and outputs control information for controlling signal processing performed by the hearing-aid signal processing unit 115, according to the determined environment. Further, the user can input a control signal to the hearing-aid processing control unit 114 by using a switch or the like provided on a hearing-aid remote control 200 or on the body of the hearing aid 100.

Aside from this, as a method in which the user himself or herself adjusts the hearing aid, there is an example where the user is assisted in adjusting the hearing aid by storing in advance test acoustic data in a remote apparatus of the hearing aid, and providing the hearing aid with a mechanism that allows reproduction of the stored test acoustic data (for example, see Patent Reference 2: Japanese Unexamined Patent Application Publication No. 2007-028609).

In addition, in the fields other than hearing aids, a speech interface has been proposed as one of the hands-free input interfaces. The speech interface provides the users with easy usage without the need to use hands, and is thus applied to a variety of appliances such as computers, car navigations, and mobile phones. Hearing aids having a speech interface are not in practical use yet. However, since hearing aids are small appliances difficult for the users to handle, the speech interface is considered to be an effective replacement for manual input interface using a switch and the like.

Furthermore, in general, microphones include air-conduction microphones that detect sounds by detecting the air oscillations, and contact microphones that detect sounds by detecting the oscillations of the user's body parts such as bones or skin. Contact microphones include bone-conduction microphones that detect the oscillations of the user's bones, and skin-conduction microphones that detect the oscillations of the user's skin. Contact microphones generally have a structure in which an oscillation plate that detects sound oscillations is covered by an external sound insulation wall (case) (for example, see Patent Reference 3: Japanese Patent No. 3760173, Patent Reference 4: Japanese Unexamined Patent Application Publication No. 2007-101305, and Patent Reference 5: Japanese Unexamined Patent Application Publication No. 2007-259008). Further, contact microphone are characterized in being impervious to a noise getting mixed and capable of detecting small utterance compared to normal air-conduction microphones.

SUMMARY OF THE INVENTION

As described, in general, the user controls a hearing aid using a switch or the like provided on the body of the hearing aid or on a remote control, in order to obtain a sound that the user wishes to hear.

However, by merely switching programs installed in the hearing aid or adjusting the volume through the user's operation using the switch or the like, it is difficult to reflect, on the hearing aid, minute requests of the user arising from each situation. For example, when the user of a hearing aid which is adjusted using a switch provided on the body of the hearing aid wishes to switch between the hearing-aid processing, the user needs to check the switch position by groping for the switch or by using a mirror and so on. When the user of a hearing aid which is adjusted using a remote control that comes with the hearing aid wishes to switch between the hearing-aid processing, the user needs to always carry the remote control and take it out from a pocket, for example, to operate it. Consequently, with such conventional structures, it is difficult for the user to smoothly switch between the hearing-aid processing.

Additionally, when the hearing aid automatically determines the surrounding environment to provide the user with "hearing" suited to the environment, misrecognition by the hearing aid may cause user discomfort.

Moreover, when the user utters a voice to control the hearing aid, the voice is heard by people around, thereby causing a problem that the user's psychological resistance is large.

The present invention is to solve the above described problems with the conventional art, and it is an object of the present invention to provide a hearing aid that provides "hearing" that the user wishes to obtain, by conveying the user's personal intention to the hearing aid using a method that does not place heavy physical and psychological loads, and by appropriately controlling the hearing-aid processing according to the conveyed intention.

To achieve the above object, the hearing aid according to one aspect of the present invention is a hearing aid to be worn by a user for auditory compensation, the hearing aid comprising: at least one microphone which converts a sound to an input signal; a hearing-aid signal processing unit configured to generate an output signal from the input signal; an output unit configured to output, as a sound, the output signal generated by the hearing-aid signal processing unit; and a hearing-aid processing control unit configured to generate control information for controlling signal processing, based on a non-audible sound which is made by the user and is hard to hear from outside, wherein, when the hearing-aid processing control unit generates the control information, the hearing-aid signal processing unit is configured to generate the output signal according to the generated control information.

This makes it possible to control hearing-aid processing based on a non-audible sound that is hard for people around the user to hear, and therefore, the user can convey his or her intention to the hearing aid without psychological resistance. In addition, since the hearing-aid processing can be controlled based on a sound, the user is not required to take out a hearing-aid remote control from a pocket or to check the switch position when conveying his or her intention to the hearing aid. In other words, the physical load on the user can be reduced.

Further, it is preferable that the microphone includes: a first microphone which converts a sound transmitted through air to a first input signal; and a second microphone which converts a sound transmitted through a body of the user to a second input signal, the hearing-aid signal processing unit is configured to generate an output signal from the first input signal, and the hearing-aid processing control unit is configured to detect a non-audible sound included in the second input signal and generate the control information based on the detected non-audible sound.

This makes it possible to detect a non-audible sound from a sound transmitted through the user's body, thereby allowing detection of a non-audible sound regardless of the loudness of the surrounding noise.

It is further preferable that the hearing-aid processing control unit includes a correlation calculation unit configured to calculate a value of correlation between the first input signal and the second input signal, and the hearing-aid processing control unit is configured to detect the non-audible sound included in the second input signal when the correlation value calculated by the correlation calculation unit is smaller than a threshold.

This makes it possible to detect a non-audible sound when the correlation between the sound detected by the first microphone and the sound detected by the second microphone is low, thereby allowing reduction of the possibility of detecting, as a non-audible sound, a sound which is not a non-audible sound.

Furthermore, it is preferable that the correlation calculation unit is configured to determine, for each of time segments, whether or not power of the first input signal exceeds a first threshold and whether or not power of the second input signal exceeds a second threshold, and to calculate the correlation value which decreases with increase in the number of time segments for which the power of the first input signal is determined as not exceeding the first threshold and the power of the second input signal is determined as exceeding the second threshold.

This makes it possible to detect a non-audible sound included in the second input signal when the sound detected by the first microphone is small and the sound detected by the second microphone is loud, thereby allowing reduction of the possibility of detecting, as a non-audible sound, a sound which is not a non-audible sound.

It is also preferable that the hearing-aid processing control unit includes a noise suppression unit configured to subtract the first input signal from the second input signal, and the hearing-aid processing control unit is configured to detect the non-audible sound included in the second input signal after the subtraction by the noise suppression unit.

This makes it possible to eliminate a noise even when a sound transmitted through the air is mixed into the sound detected by the second microphone as a noise, and therefore a non-audible sound can be detected with higher precision. In addition, since it is possible to miniaturize a structural component such as a sound insulation wall provided to the second microphone in order to suppress mixing of a noise, the size reduction of the hearing aid body is also possible.

The integrated circuit according to one aspect of the present invention is an integrated circuit for use in a hearing aid to be worn by a user for auditory compensation, wherein the hearing aid includes: at least one microphone which converts a sound to an input signal; and an output unit configured to output an output signal as a sound, and the integrated circuit comprises: a hearing-aid signal processing unit configured to generate the output signal from the input signal; and a hearing-aid processing control unit configured to generate control information for controlling signal processing, based on a non-audible sound which is made by the user and is hard to hear from outside, wherein, when the hearing-aid processing control unit generates the control information, the hearing-aid signal processing unit is configured to generate the output signal according to the generated control information.

The hearing-aid processing method according to one aspect of the present invention is a hearing-aid processing method for use with a hearing aid to be worn by a user for auditory compensation, wherein the hearing aid includes: at least one microphone which converts a sound to an input signal; and an output unit configured to output an output signal as a sound, and the hearing-aid processing method comprises: generating the output signal from the input signal; and generating control information for controlling signal processing, based on a non-audible sound which is made by the user and is hard to hear from outside, wherein, when the control information is generated in the generating of control information, the output signal is generated in the generating of the output signal according to the generated control information.

It is to be noted that the present invention can be implemented not only as the hearing-aid processing method as above, but also as a program that causes a computer to execute steps of the hearing-aid processing method. Further, it goes without saying that such a program can be distributed via a recording medium such as a CD-ROM or a transmission medium such as the Internet.

Since the hearing aid according to the present invention controls the hearing-aid processing based on a non-audible sound that is hard for people around the user to hear, the user can convey his or her intention to the hearing aid without psychological resistance. In addition, since the hearing aid according to the present invention controls the hearing-aid processing based on a sound, the user is not required to take out a hearing-aid remote control from a pocket or to check the switch position when conveying his or her intention to the hearing aid. In other words, the hearing aid according to the present invention makes it possible to reduce the physical load on the user.

Further Information About Technical Background to This Application

The disclosures of Japanese Patent Application No. 2008-137575 filed on May 27, 2008 and Japanese Patent Application No. 2009-123100 filed on May 21, 2009 including specifications, drawings and claims are incorporated herein by reference in their entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings:

FIG. 5 illustrates an example of an intention information table;

FIG. 6 illustrates an example of a control information table;

DESCRIPTION OF THE PREFERRED EMBODIMENT(S)

Hereinafter, embodiments of the present invention shall be described with reference to the drawings.

(Embodiment 1)

First, Embodiment 1 of the present invention shall be described below.

A hearing aid 10 according to the present embodiment is characterized in controlling signal processing based on a non-audible sound, rather than controlling hearing-aid processing according to an input signal from a switch provided on the body of the hearing aid or on a hearing-aid remote control. The hearing aid 10 according to the present embodiment is also characterized in detecting a non-audible sound included in a second input signal which indicates a sound transmitted through the user's body.

Figure 1:
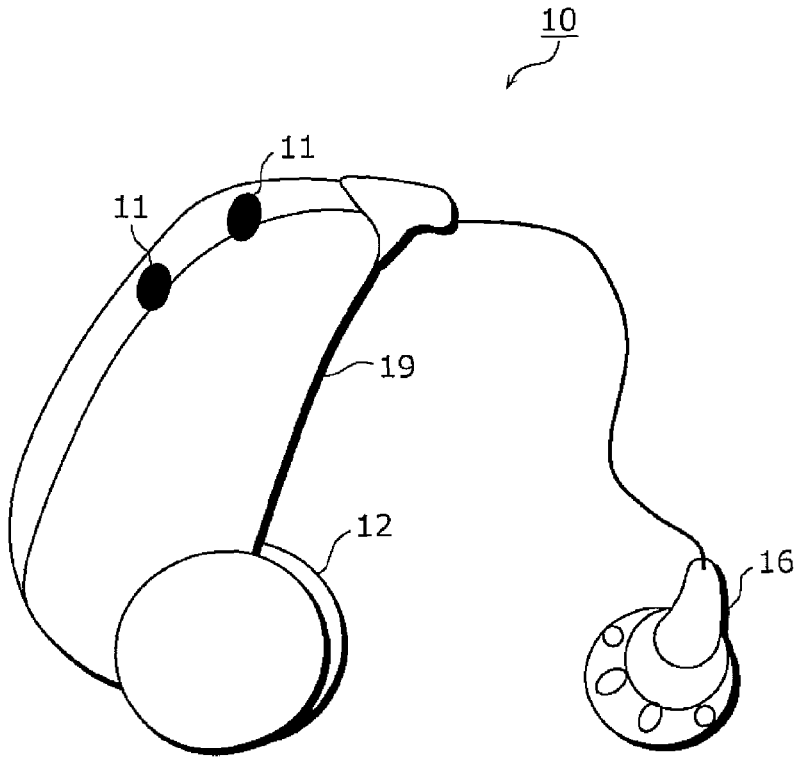
FIG. 1 is an external view of an example of a hearing aid according to Embodiment 1 of the present invention.

FIG. 1 is an external view illustrating an example of the hearing aid 10 according to Embodiment 1 of the present invention. As shown in FIG. 1, the hearing aid 10 described in the present embodiment is a Behind-the-Ear aid as an example. The hearing aid 10 includes air-conduction microphones 11, a contact microphone 12, a receiver 16, and a case 19.

The air-conduction microphones 11 convert a sound to an electric signal by detecting oscillations transmitted through the air. It is to be noted that although the hearing aid 10 in FIG. 1 includes two air-conduction microphones 11, the hearing aid according to the present invention may include one or three or more air-conduction microphones.

The contact microphone 12 converts a sound to an electric signal by detecting oscillations transmitted through the inside or surface of the user's body. Therefore, the user needs to wear the hearing aid 10 in such a manner that the user's skin and the contact microphone 12 are in close contact with one another with no space therebetween. Thus, the contact area between the contact microphone 12 and the user's skin or the contact area between the case 19 and the user's skin is desirably made of an adhesive material. With this structure, the hearing aid 10 is fixed not only by being placed behind the ear as in the conventional way, but also by the adhesion of the adhesive material to the skin. That is to say, the user can wear the hearing aid 10 at a position more flexible than that with the conventional hearing aids.

It is to be noted that the hearing aid according to the present invention is not necessarily required to use an adhesive material for the contact area. For example, as long as there is no layer of the air between the skin and the contact microphone 12 when the hearing aid is worn by the user, the hearing aid may be fixed to the user using a small dedicated tool.

Figure 2:
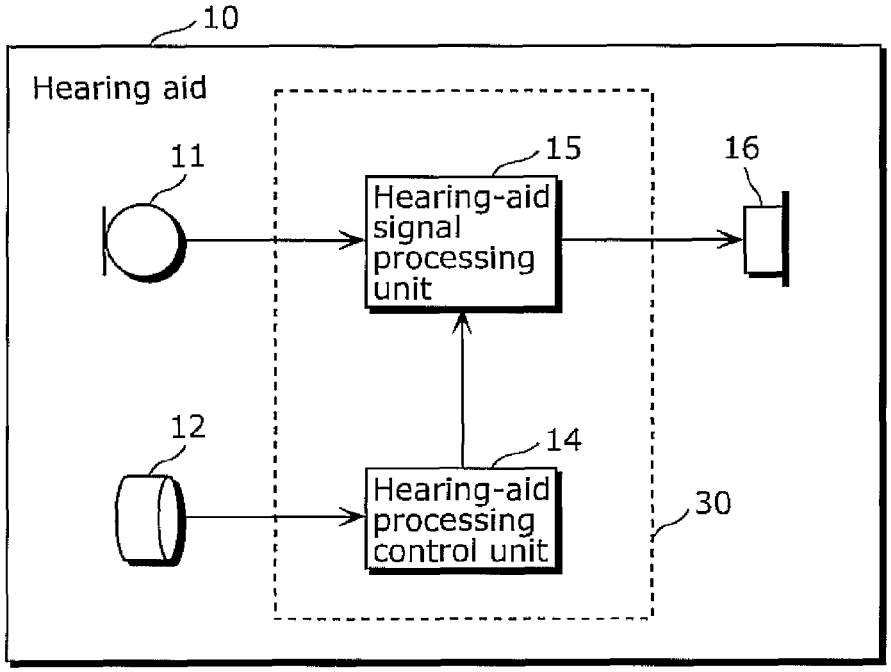
FIG. 2 is a block diagram illustrating the functional structure of a hearing aid according to Embodiment 1 of the present invention.

FIG. 2 is a block diagram illustrating the functional structure of the hearing aid 10 according to Embodiment 1 of the present invention. As shown in FIG. 2, the hearing aid 10 includes the air-conduction microphones 11, the contact microphone 12, a hearing-aid processing control unit 14, a hearing-aid signal processing unit 15, and the receiver 16.

The air-conduction microphones 11 are an example of the first microphone, and convert a sound transmitted through the air to a first input signal.

The contact microphone 12 is an example of the second microphone, and converts a sound transmitted through the user's body to a second input signal. The contact microphone 12 is, for example, a bone-conduction microphone that detects the oscillations of the user's bones or a skin-conduction microphone that detects the oscillations of the user's skin.

The hearing-aid processing control unit 14 detects, in the second input signal, a non-audible sound which is made by the user and is hard to hear from outside, and generates control information for controlling signal processing, based on the detected non-audible sound. Here, outside means people around the user. Thus, a non-audible sound is a small sound made by the user and is hard for people around the user to hear. More specifically, a non-audible sound is, for example, the user's intentional or unintentional murmur, a sound intentionally made by the user in mouth (a sound created by clicking teeth, a click, and so on), or a friction sound made between the user's hair or skin and the hearing aid.

To be more specific, the hearing-aid processing control unit 14 determines whether or not the second input signal includes language information by performing, for example, a cepstrum analysis on the second input signal. Here, when determining that language information is included, the hearing-aid processing control unit 14 identifies the language spoken by the user and generates control information according to the identified language. On the other hand, when determining that language information is not included, the hearing-aid processing control unit 14 detects a non-audible sound, such as a sound created by clicking teeth, by analyzing a spectrum in a specific frequency band, and generates control information according to the detected sound. It is to be noted that the processing for determining the presence or absence of language information and the processing for detecting a characteristic sound, such as a click and a sound created by clicking teeth, may be performed concurrently, or one of them may be performed after the other. Further, determination as to, for example, the order of the processing or which processing should be performed alone may be made according to the program mode of the hearing-aid processing.

The hearing-aid signal processing unit 15 generates an output signal from the first input signal. Further, when the hearing-aid processing control unit 14 has generated the control information, the hearing-aid signal processing unit 15 generates an output signal from the first input signal according to the generated control information. To be more specific, the hearing-aid signal processing unit 15 performs signal processing, which is implemented by a directional function or a noise suppression function, for example, on the first input signal, and amplifies the first input signal so that the sound is outputted at a predetermined sound pressure level. Here, the directional function is a function for enhancing the sensitivity of a sound transmitted from a particular direction, by utilizing the fact that the time difference created between the first input signals generated by the respective air-conduction microphones 11 differs depending on the direction from which the sound is transmitted. The noise suppression function is a function for improving the SN ratio of the output signal by eliminating, as a noise, a signal of a specific pattern included in the first input signal.

The receiver 16 is an example of the output unit, and outputs the output signal as a sound. More specifically, the receiver 16 is an earphone, for example, and outputs a sound to the user's ear. The receiver 16 may be a bone-conduction speaker, for example, which outputs a sound to the user by causing the user's body to make oscillations.

Next, the operations of the hearing aid 10 having the above structure according to the present embodiment shall be described.

Figure 3:
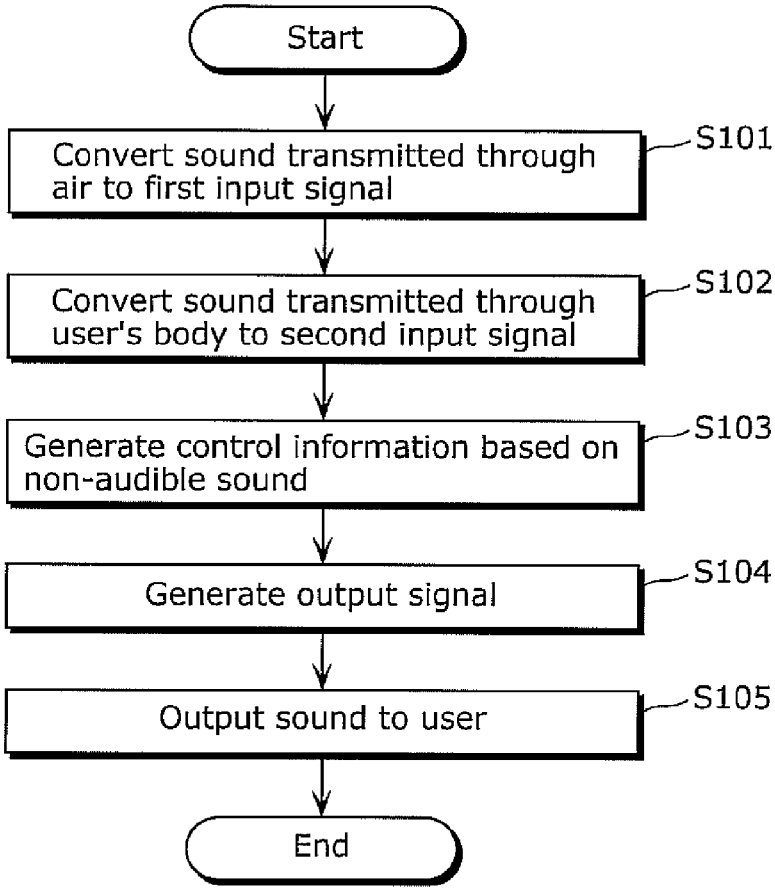
FIG. 3 is a flowchart illustrating operations of a hearing aid according to Embodiment 1 of the present invention.

FIG. 3 is a flowchart illustrating the operations of the hearing aid 10 according to Embodiment 1 of the present invention.

First, the air-conduction microphones 11 convert, to a first input signal, a sound transmitted through the air, including a voice from a person other than the user or an environmental sound that is a sound around the user (a quiet indoor sound, an outdoor noise, and so on) (Step S101).

Further, the contact microphone 12 converts, to a second input signal, a sound transmitted through the inside or surface of the user's body, including a non-audible sound (Step S102). The non-audible sound is a sound too small to be heard by a person other than the user, and is thus very hard to be detected by the air-conduction microphones 11. In the contact microphone 12, a microphone unit that detects a sound is covered by an external sound insulation wall, thereby insulating the outside noise. Consequently, the non-audible sound is included only in the sound detected by the contact microphone 12.

Next, based on the non-audible sound, the hearing-aid processing control unit 14 generates control information for controlling the hearing-aid processing performed by the hearing-aid signal processing unit 15. Then, the hearing-aid processing control unit 14 transmits the generated control information to the hearing-aid signal processing unit 15 (Step S103).

More specifically, the hearing-aid processing control unit 14 detects a non-audible sound included in the second input signal generated by the contact microphone 12, and generates control information based on the detected non-audible sound. For example, when detecting the user's murmur of a name of a program mode as a non-audible sound, the hearing-aid processing control unit 14 generates control information instructing a change to the program mode indicated in the language contained in the detected non-audible sound. Further, when detecting as a non-audible sound a sound created by the user clicking teeth twice, for example, the hearing-aid processing control unit 14 generates control information instructing suspension of the output signal generation.

Furthermore, when frequently detecting a friction sound made between the hair or skin and the hearing aid 10, the hearing-aid processing control unit 14 transmits control information for invalidating the directional function to the hearing-aid signal processing unit 15. When a friction sound made between the hair or skin and the hearing aid 10 is frequently detected, it means that the user's head is moving frequently. In other words, it is highly likely that the user is unintentionally moving the head frequently to search for a surrounding sound. In such a case, the hearing-aid processing control unit 14 generates the control information for invalidating the directional function so that it is possible to provide "hearing" that suits the user's situation and psychological status.

Next, the hearing-aid signal processing unit 15 generates an output signal from the first input signal provided by the air-conduction microphones 11, according to the control information received from the hearing-aid processing control unit 14. Then, the hearing-aid signal processing unit 15 outputs the generated output signal to the receiver 16 (Step S104). For example, when receiving control information indicating an instruction to turn the volume down, the hearing-aid signal processing unit 15 reduces the amplification rate for amplifying the input signal such that the sound pressure level of the sound outputted from the receiver 16 decreases by a predetermined value.

Lastly, the receiver 16 outputs the output signal as a sound (Step S105).

As described above, the hearing aid 10 according to the present embodiment can control the hearing-aid processing based on a non-audible sound that is hard for people around the user to hear, and therefore, the user can convey his or her intention to the hearing aid without psychological resistance. In addition, since the hearing aid 10 controls the hearing-aid processing based on a sound, the user is not required to take out a hearing-aid remote control from a pocket or to check the switch position when conveying his or her intention to the hearing aid, thereby allowing reduction of the physical load on the user.

Moreover, the inclusion of the contact microphone 12 allows the hearing aid 10 to detect a non-audible sound from a sound transmitted through the user's body, thereby allowing detection of a non-audible sound regardless of the loudness of the surrounding noise.

Non-audible sounds include voices unintentionally spoken by humans, which mainly include murmurs that are voices spoken mostly when the speaker does not wish other people to hear. Murmurs, which are spoken unintentionally although not directed to other people, often strongly reflect the user's emotions. Thus, the hearing aid 10 can reflect the user's emotions or intentions on the hearing-aid processing by controlling the hearing-aid processing using non-audible sounds that include many sounds unintentionally made by the user in addition to sounds intentionally made by the user. In other words, the hearing aid 10 can provide "hearing" that the user wishes to obtain because the detection of non-audible sounds allows detection of the user's emotions or intentions.

(Embodiment 2)

Next, Embodiment 2 of the present invention shall be described.

Figure 4:
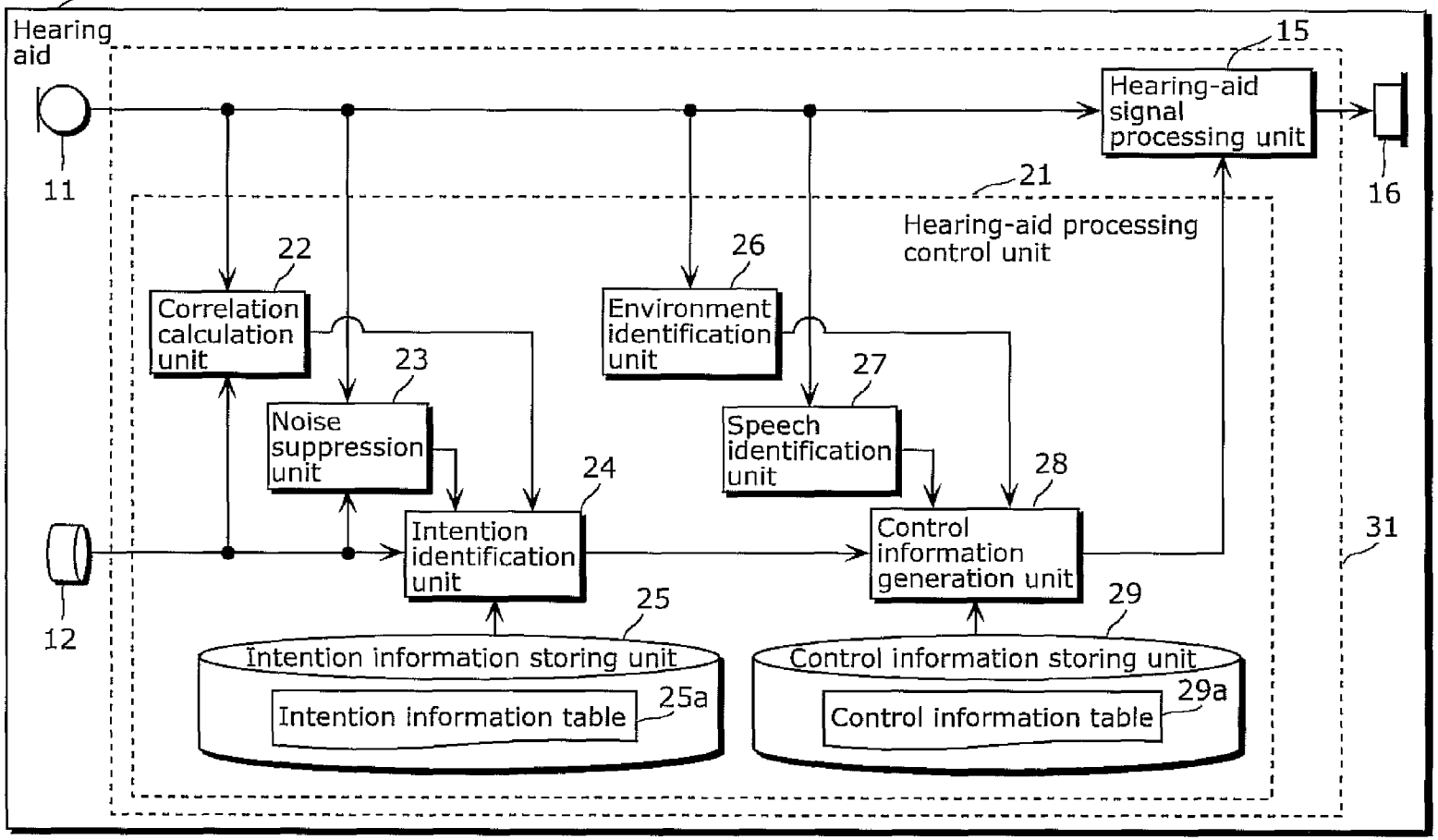
FIG. 4 is a block diagram illustrating the functional structure of a hearing aid according to Embodiment 2 of the present invention.

FIG. 4 is a block diagram illustrating the functional structure of a hearing aid 20 according to Embodiment 2 of the present invention. The constituent elements in FIG. 4 that are identical to those in the hearing aid 10 of Embodiment 1 shown in FIG. 2 are assigned the same reference numerals, and the descriptions thereof are omitted.

As shown in FIG. 4, a hearing-aid processing control unit 21 includes a correlation calculation unit 22, a noise suppression unit 23, an intention identification unit 24, an intention information storing unit 25, an environment identification unit 26, a speech identification unit 27, a control information generation unit 28, and a control information storing unit 29.

The correlation calculation unit 22 calculates a value of correlation between the first input signal provided by the air-conduction microphones 11 and the second input signal provided by the contact microphone 12. To be more specific, the correlation calculation unit 22 determines, for each time segment, whether or not the power of the first input signal exceeds a first threshold and whether or not the power of the second input signal exceeds a second threshold. Then, the correlation calculation unit 22 calculates a correlation value which decreases with increase in the number of time segments for which the power of the first input signal is determined as not exceeding the first threshold and the power of the second input signal is determined as exceeding the second threshold.

The noise suppression unit 23 subtracts the first input signal from the second input signal. That is to say, by subtracting the first input signal from the second input signal, the noise suppression unit 23 eliminates the sound components mixed into the second input signal and transmitted through the air. It is to be noted that since the first input signal and the second input signal which are provided by different types of microphones have different transmission properties, the subtraction may be performed after multiplying one or both of the signals by an appropriate gain based on the difference.

The intention identification unit 24 detects a non-audible sound included in the second input signal when the correlation value calculated by the correlation calculation unit 22 is smaller than a threshold. Then, the intention identification unit 24 estimates an intention of the user based on characteristics indicated by the detected non-audible sound. To be more specific, the intention identification unit 24 determines whether or not the second input signal includes language information by performing, for example, a cepstrum analysis on the second input signal. Here, when determining that language information is included, the intention identification unit 24 identifies the language spoken by the user and detects the identified language as a non-audible sound. On the other hand, when determining that language information is not included, the intention identification unit 24 detects a sound such as a sound created by clicking teeth as a non-audible sound by analyzing a spectrum in a specific frequency band. Then, the intention identification unit 24 obtains intention information associated with the characteristics (language, type of sound, for example) of the detected non-audible sound by referring to an intention information table 25*a* stored in the intention information storing unit 25.

The intention information storing unit 25 stores correspondence relationships between non-audible sound information indicating characteristics of non-audible sounds and intention information indicating intentions of the user. To be more specific, the intention information storing unit 25 stores the intention information table 25*a*, for example. The details of the intention information table 25*a* are described later with reference to FIG. 5.

The environment identification unit 26 determines the loudness of a noise in the first input signal. More specifically, the environment identification unit 26 calculates the total power that is a sum of the power spectrums of the first input signal in all of the bands. Then, the environment identification unit 26 determines the loudness of the noise by determining whether or not the calculated total power exceeds a threshold. It is to be noted that the environment identification unit 26 may calculate the total power after eliminating the noise components contained in the first input signal by using a smoothing filter. Further, the environment identification unit 26 may determine the loudness of the noise based on plural levels such as "high", "medium", and "low", using plural thresholds.

The speech identification unit 27 determines the presence or absence of language information in the first input signal. To be more specific, the speech identification unit 27 determines whether or not the sound detected by the air-conduction microphones 11 includes a conversation, by performing a cepstrum analysis on the first input signal, for example.

The control information generation unit 28 generates control information based on the user's intention estimated by the intention identification unit 24, the loudness of the noise determined by the environment identification unit 26, and the determination by the speech identification unit 27 as to the presence or absence of language information. More specifically, the control information generation unit 28 refers to a control information table 29*a* stored in the control information storing unit 29, and obtains control information associated with the user's intention estimated by the intention identification unit 24, the loudness of the noise determined by the environment identification unit 26, and the determination by the speech identification unit 27 as to the presence or absence of language information.

The control information storing unit 29 stores correspondence relationships between: intention information indicating the user's intentions, noise information indicating the loudness of a noise, and speech information indicating the presence or absence of language information; and control information. To be more specific, the control information storing unit 29 stores the control information table 29*a*, for example. The details of the control information table 29*a* are described later with reference to FIG. 6.

FIG. 5 illustrates an example of the intention information table 25*a*. As shown in FIG. 5, the intention information table 25*a* stores non-audible sound information and intention information.

Non-audible sound information is information indicating characteristics of a non-audible sound. Intention information is information indicating the user's intention. The intention information table 25*a* shown in FIG. 5 indicates that the user's intention is "the noise is too loud" when a non-audible sound is a language "too loud" or "quieter", for example. The intention information table 25*a* further indicates that the user's intention is "want to invalidate all functions" when a non-audible sound is a sound created by clicking teeth.

FIG. 6 illustrates an example of the control information table 29*a*. As shown in FIG. 6, the control information table 29*a* stores intention information, noise information, speech information, and control information.

Intention information is the same as the intention information shown in FIG. 5, and is information indicating the user's intention. Noise information is information indicating the loudness of a surrounding noise. Speech information is information indicating the presence or absence of language information. Control information is information for controlling the hearing-aid processing. The control information table 29*a* shown in FIG. 6 indicates, for example, that the information for controlling the hearing-aid processing is "maximize noise suppression level" when the user's intention is "can't hear conversation", the loudness of the surrounding noise is "high", and whether or not there is a surrounding speech is "yes".

The operations of the hearing aid 20 having the above structure according to the present embodiment shall be described.

Figure 7:
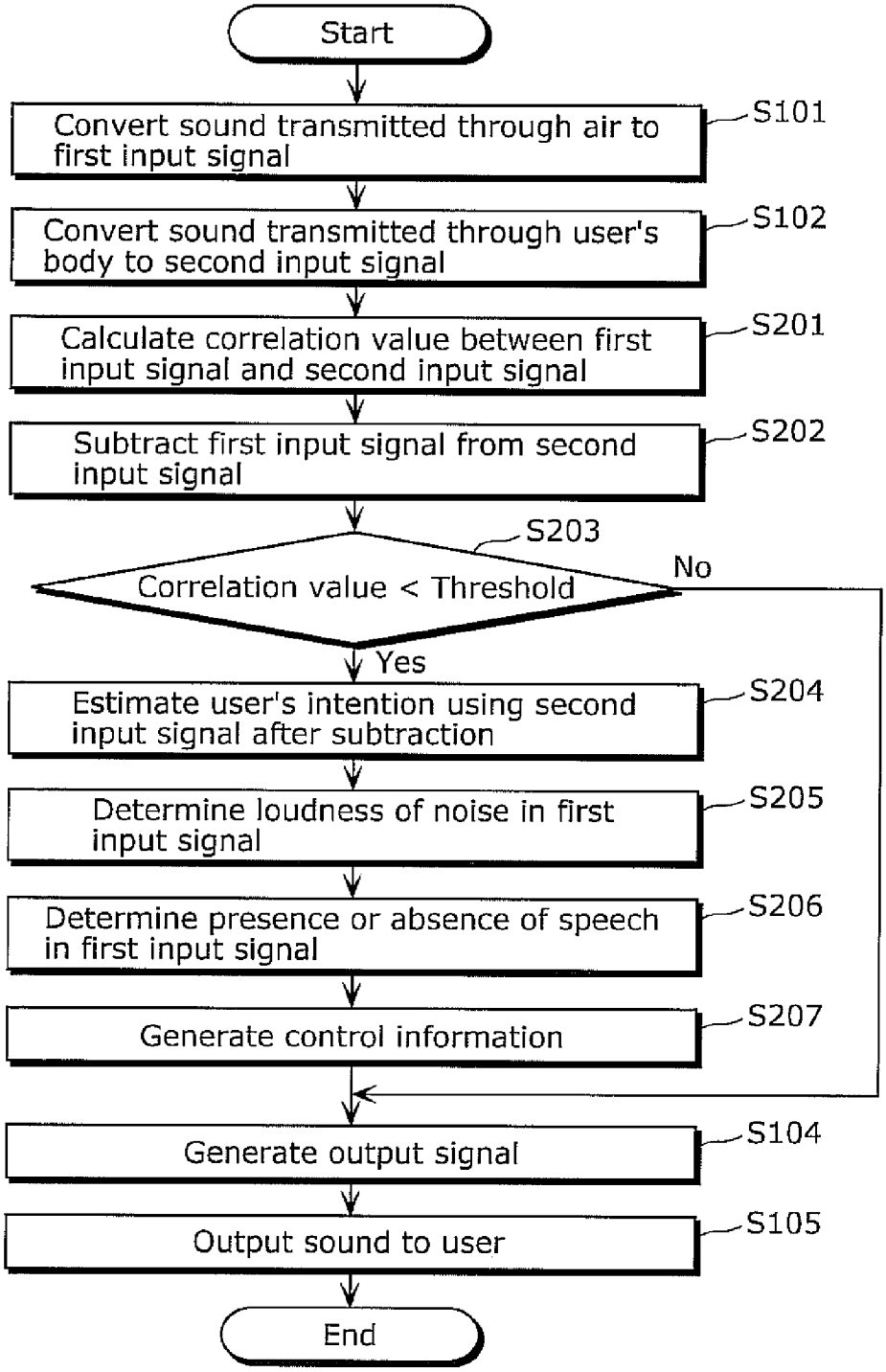
FIG. 7 is a flowchart illustrating operations of a hearing aid according to Embodiment 2 of the present invention.
Figure 8:
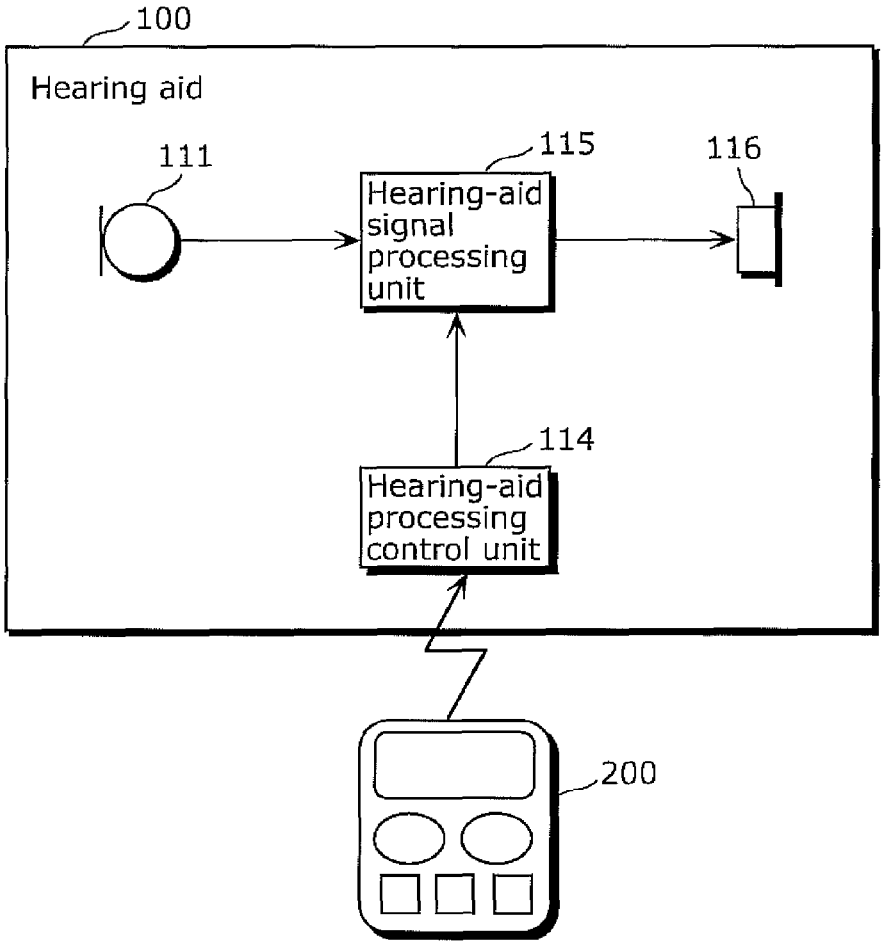
FIG. 8 is a block diagram illustrating the functional structure of a conventional hearing aid.

FIG. 7 is a flowchart illustrating the operations of the hearing aid 20 according to Embodiment 2 of the present invention. The processing in FIG. 7 that are identical to that in FIG. 3 are assigned the same reference numerals, and the descriptions thereof are omitted.

Subsequent to the processing of Step S102, the correlation calculation unit 22 calculates a value of correlation between the first input signal provided by the air-conduction microphones 11 and the second input signal provided by the contact microphone 12 (Step S201).

To be more specific, the correlation calculation unit 22 calculates the total power of the first input signal for each time segment, and determines whether or not each total power calculated exceeds a first threshold. The correlation calculation unit 22 further calculates the total power of the second input signal for each time segment, and determines whether or not each total power calculated exceeds a second threshold. Here, the correlation calculation unit 22 calculates "0" as an individual correlation value of a corresponding time segment when the total power of the first input signal does not exceed the first threshold and the total power of the second input signal exceeds the second threshold, and calculates "1" as an individual correlation value of a corresponding time segment in other cases. The correlation calculation unit 22 calculates a correlation value by dividing a sum of the calculated individual correlation values by the number of time segments.

Next, the noise suppression unit 23 subtracts the first input signal from the second input signal (Step S202). Then, the intention identification unit 24 determines whether or not the correlation value is smaller than a predetermined threshold (Step S203). Here, when it is determined that the correlation value is equal to or larger than the threshold (No in Step S203), the processing of Step S104 is performed.

On the other hand, when it is determined that the correlation value is smaller than the threshold (Yes in Step S203), the intention identification unit 24 estimates the user's intention by using the second input signal after the subtraction in Step S202 (Step S204). To be more specific, for example, the intention identification unit 24 identifies a language indicated by a murmur that is a non-audible sound, by detecting language information included in the sound detected by the contact microphone 12. Then, the intention identification unit 24 obtains intention information associated with the identified language by referring to the intention information table 25*a*. For example, when the identified language is "can't hear", the intention identification unit 24 estimates that the user's intention is "can't hear conversation" by referring to the intention information table shown in FIG. 5.

Next, the environment identification unit 26 determines the loudness of a noise in the first input signal (Step S205). More specifically, the environment identification unit 26 determines the loudness of the noise by determining whether or not the total power of the first input signal exceeds a predetermined threshold. For example, the environment identification unit 26 determines the loudness of the noise as "high" when determining that the total power of the first input signal exceeds a predetermined threshold.

Then, the speech identification unit 27 determines the presence or absence of language information in the first input signal (Step S206). To be more specific, the speech identification unit 27 determines whether or not language information is included in the first input signal by performing a cepstrum analysis on the first input signal.

Next, by referring to the control information table 29*a*, the control information generation unit 28 generates control information associated with the user's intention, the loudness of the noise, and the presence or absence of language information (Step S207). For example, when the user's intention is "can't hear conversation", the loudness of the noise is "high", and whether or not language information is included is "yes", the control information generation unit 28 refers to the control information table 29*a* shown in FIG. 6 and generates control information "maximize noise suppression level".

As described above, the hearing aid 20 according to the present embodiment detects a non-audible sound using both the sound detected by the air-conduction microphones 11 and the sound detected by the contact microphone 12. The air-conduction microphones 11 detect a normal speech and a small voice spoken at the normal loudness level of the user, as well as detecting a voice of a person other than the user and an environmental sound from the user's surroundings, but cannot detect a non-audible sound such as a murmur because its power is small. In contrast, the contact microphone 12 detects all the voices of the user ranging from a normal speech to a non-audible sound that are transmitted through the body as oscillations. Therefore, when the correlation value between the first input signal and the second input signal is great, it is highly likely that the user's voice is not a non-audible sound but is a voice such as a normal speech. On the other hand, when the correlation value is small, it is highly likely that the user is making a non-audible sound that is detected only by the contact microphone 12. Thus, the hearing aid 20 can control the hearing-aid processing based only on the user's non-audible sound by analyzing the second input signal provided by the contact microphone 12, only when the correlation value is small. In other words, since the hearing aid 20 according to the present embodiment detects a non-audible sound only when the correlation value between the first input signal and the second input signal is small, it is possible to reduce the possibility of detecting, as a non-audible sound, a sound which can be heard by other people.

In addition, the hearing aid 20 can eliminate the noise mixed into the second input signal by subtracting the first input signal from the second input signal. Generally, with the contact microphone 12, the oscillation sensor is often covered by an external sound insulation wall in order to prevent the noise transmitted through the air from getting mixed as a noise. However, since the hearing aid is a very small appliance, the external sound insulation wall is desirably small in order to achieve miniaturization of the microphone. When the external sound insulation wall is small, however, there is a higher possibility for a noise to get mixed. Here, when the hearing aid includes the noise suppression unit 23, the noise suppression unit 23 can eliminate the noise components included in the second input signal, by subtracting the first input signal from the second input signal. Thus, when the hearing aid includes the noise suppression unit 23, it is possible to reduce the size of the external sound insulation wall of the contact microphone 12. In other words, since the hearing aid 20 according to the present embodiment includes the noise suppression unit 23, the miniaturization of the contact microphone is possible, which leads to miniaturization the body of the hearing aid.

Although only some exemplary embodiments of the hearing aid according to the present invention have been described above, the present invention is not limited to these exemplary embodiments. Those skilled in the art will readily appreciate that many modifications in the exemplary embodiments or combinations of the constituent elements in different exemplary embodiments are possible without materially departing from the novel teachings and advantages of the present invention. Accordingly, all such modifications and combinations are intended to be included within the scope of the present invention.

For example, although the noise suppression unit 23 in Embodiment 2 simply subtracts the first input signal from the second input signal, it may perform the subtraction after performing signal processing, such as a transfer function correction, on the first input signal or the second input signal.

Further, although the correlation calculation unit 22 in Embodiment 2 calculates a correlation value by using the total power of the first input signal and the second input signal, it may calculate a correlation value by using the power of a specific frequency band. Furthermore, the correlation calculation unit 22 may calculate a correlation value by using the power of each frequency band. Moreover, the correlation calculation unit 22 may calculate a correlation value after performing signal processing, such as a transfer function correction, on the first input signal or the second input signal. Further, the correlation calculation unit 22 may use an adaptive filter and determine the degree of convergence/divergence of adaptive filter coefficients and error signals based on a threshold or the like, or statistically calculate a correlation coefficient and determine the correlation coefficient based on a threshold and the like.

Further, although the intention identification unit 24 in Embodiment 2 estimates the user's intention when a correlation value is smaller than a predetermined threshold, the threshold may be varied according to characteristics indicated by the first input signal or the second input signal. For example, the intention identification unit 24 may detect the loudness of the noise from the first input signal and determine a threshold such that a threshold is greater when the detected loudness of the noise is greater. This enables accurate detection of non-audible sounds even in a high-level noise situation where a speech distortion known as the Lombard effect occurs and the volume of the user's voice unintentionally increases.

In addition, although the hearing aid in the above embodiments controls the hearing-aid processing based on a non-audible sound, a conventionally-used hearing-aid remote control may also be used. When both a non-audible sound and a control signal outputted by a hearing-aid remote control are used for controlling the hearing aid, each of the hearing-aid processing control unit and the hearing-aid remote control desirably has a function for switching between a non-audible sound mode and a remote control mode. Here, the non-audible sound mode is a mode for controlling the hearing-aid processing based on a non-audible sound. The remote control mode is a mode for controlling the hearing-aid processing based on a control signal outputted by the hearing-aid remote control. For example, in the non-audible sound mode, when the user murmurs "switch" in a non-audible sound, the hearing-aid processing control unit detects the non-audible sound and switches to the remote control mode regardless of the surrounding environment, such as the noise level is high or low. On the other hand, in the remote control mode, when the user presses an "operation switching button" provided on the hearing-aid remote control, the hearing-aid processing control unit switches to the non-audible sound mode according to a control signal outputted by the hearing-aid remote control. It is to be noted that in the non-audible sound mode, the hearing-aid processing control unit does not accept a control signal outputted by the hearing-aid remote control. On the other hand, in the remote control mode, the hearing-aid processing control unit does not detect a non-audible sound.

A part of the constituent elements constituting the above described hearing aid may be configured as a single system Large Scale Integration (LSI). A system LSI is a super-multi-function LSI manufactured by integrating constituent elements on one chip, and is specifically a computer system configured by including a microprocessor, a Read Only Memory (ROM), a Random Access Memory (RAM), and so on. For example, as shown in FIG. 2, the hearing-aid processing control unit 14 and the hearing-aid signal processing unit 15 may be configured as a single system LSI 30. Furthermore, for example, as shown in FIG. 4, the hearing-aid processing control unit 21 and the hearing-aid signal processing unit 15 may be configured as a single system LSI 31.

Industrial Applicability

The present invention is useful as a hearing aid capable of controlling hearing-aid processing according to the user's intention, and especially as an environmentally-adaptive hearing aid capable of providing the user with improved "hearing" by changing the hearing-aid processing according to the environment.

What is claimed is:

1. A hearing aid to be worn by a user for auditory compensation, said hearing aid comprising:

a first microphone which converts a sound transmitted through air to a first input signal;

a second microphone which converts a sound transmitted through a body of the user to a second input signal;

an intention identification unit configured to determine a threshold such that the threshold is greater when a loudness of a noise detected from the first input signal is greater;

a hearing-aid processing control unit configured to generate control information for controlling signal processing, based on the second input signal when a correlation value between the first input signal and the second input signal is smaller than the threshold;

a hearing-aid signal processing unit configured to generate an output signal from the first input signal according to the generated control information, when said hearing-aid processing control unit generates the control information; and an output unit configured to output, as a sound, the output signal generated by said hearing-aid signal processing unit.

2. The hearing aid according to claim 1, wherein said hearing aid further comprises a correlation calculation unit configured to determine, for each of a plurality of time segments, whether or not power of the first input signal exceeds a first threshold and whether or not power of the second input signal exceeds a second threshold, and to calculate the correlation value between the first input signal and the second input signal so that the correlation value decreases with an increase in the number of time segments for which the power of the first input signal is determined as not exceeding the first threshold and the power of the second input signal is determined as exceeding the second threshold.

3. The hearing aid according to claim 1, wherein said hearing-aid processing control unit includes a noise suppression unit configured to subtract the first input signal from the second input signal, and wherein said hearing-aid processing control unit is configured to detect a sound included in the second input signal after the subtraction by said noise suppression unit.

4. The hearing aid according to claim 3, wherein said intention identification unit is configured to estimate an intention of the user based on characteristics indicated by the detected sounds, and wherein said hearing-aid processing control unit includes a control information generation unit configured to generate the control information according to the intention of the user estimated by said intention identification unit.

5. The hearing aid according to claim 4, wherein said hearing-aid processing control unit further includes:

an environment identification unit configured to detect the loudness of the noise from the first input signal; and a speech identification unit configured to determine presence or absence of language information in the first input signal, and wherein said control information generation unit is configured to generate the control information based on the intention of the user estimated by said intention identification unit, the loudness of the noise determined by said environment identification unit, and the determination by said speech identification unit as to presence or absence of the language information.

6. An integrated circuit for use in a hearing aid to be worn by a user for auditory compensation, wherein the hearing aid includes: a first microphone which converts a sound transmitted through air to a first input signal; a second microphone which converts a sound transmitted through a body of the user to a second input signal; and an output unit configured to output an output signal as a sound, said integrated circuit comprising:

an intention identification unit configured to determine a threshold such that the threshold is greater when a loudness of a noise detected from the first input signal is greater;

a hearing-aid processing control unit configured to generate control information for controlling signal processing, based on the second input signal when a correlation value between the first input signal and the second input signal is smaller than the threshold; and a hearing-aid signal processing unit configured to generate the output signal from the first input signal according to the generated control information, when said hearing-aid processing control unit generated the control information.

7. A hearing-aid processing method for use with a hearing aid to be worn by a user for auditory compensation, wherein the hearing aid includes: a first microphone which converts a sound transmitted through air to a first input signal; a second microphone which converts a sound transmitted through a body of the user to a second input signal; and an output unit configured to output an output signal as a sound, said hearing-aid processing method comprising:

determining a threshold such that the threshold is greater when a loudness of a noise detected from the first input signal is greater;

generating control information for controlling signal processing, based on the second input signal when a correlation value between the first input signal and the second input signal is smaller than the threshold; and generating the output signal from the first input signal according to the generated control information, when said generating the control information generates the control information.

8. A computer program recorded on a non-transitory computer-readable recording medium, said computer program causing a computer included in a hearing aid to be worn by a user for auditory compensation to execute processing, wherein the hearing aid includes: a first microphone which converts a sound transmitted through air to a first input signal; a second microphone which converts a sound transmitted through a body of the user to a second input signal; and an output unit configured to output an output signal as a sound, and wherein said computer program causes the computer to execute a method comprising:

determining a threshold such that the threshold is greater when a loudness of a noise detected from the first input signal is greater;

generating control information for controlling signal processing, based on the second input signal when a correlation value between the first input signal and the second input signal is smaller than the threshold; and generating the output signal from the first input signal according to the generated control information, when said generating the control information generates the control information.

* * * * *